United States Patent [19]

Meier

[11] 4,109,905

[45] Aug. 29, 1978

[54] DEVICE FOR IN PLACE SWIMMING

[75] Inventor: Ernst Johann Meier, Mutschellen, Switzerland

[73] Assignee: Elvira Quadri, Mutschellen, Switzerland

[21] Appl. No.: 790,193

[22] Filed: Apr. 25, 1977

[51] Int. Cl.[2] ..... A63B 69/12

[52] U.S. Cl. ..... 272/71; 9/310 J; 24/115 H; 272/136; 272/143; 273/DIG. 19

[58] Field of Search ..... 272/1 B, 71, 109, 116, 272/119, 135, 136, 137, 138, 139, 143, 144, 125, 142; 273/DIG. 19; 128/94; 9/301, 30 T, 310 J, 311, 329, 336, 340; 119/100, 101, 102; D30/33; 294/74; 182/3, 4; 24/115 H, 115 M, 136 R, 136 A; 35/29 B

[56] References Cited

U.S. PATENT DOCUMENTS

| | | | |
|---|---|---|---|
| 1,586,251 | 5/1926 | Lang | 24/115 H X |
| 2,572,889 | 10/1951 | Strykower | 24/115 H X |
| 2,950,489 | 8/1960 | Pattison | 9/340 |
| 3,193,288 | 7/1965 | De Spain et al. | 272/136 |
| 3,988,020 | 10/1976 | Carter | 272/143 |

FOREIGN PATENT DOCUMENTS

| | | | |
|---|---|---|---|
| 765,717 | 8/1967 | Canada | 272/71 |
| 27,305 | 3/1921 | Denmark | 272/71 |
| 1,190,849 | 5/1960 | Fed. Rep. of Germany | 272/71 |
| 436,348 | 4/1925 | Fed. Rep. of Germany | 272/136 |
| 21,999 of | 1899 | United Kingdom | 272/136 |

OTHER PUBLICATIONS

A Swimming Handbook by E. D. McAllister, B.S. 1961 Art-Craft Press, Cortland, N.Y. p. 5, Swim Belt.

*Primary Examiner*—Richard C. Pinkham
*Assistant Examiner*—Arnold W. Kramer
*Attorney, Agent, or Firm*—McDougall, Hersh & Scott

[57] ABSTRACT

A device to be used in a swimming pool for in place swimming is disclosed. This device consists of a foam rubber belt attached to a flexible cord. The belt is placed around the abdomen of a swimmer and the cord is secured to the side of the pool. The swimmer then practices swimming strokes in place against the restraint of the cord. The belt is water absorbent so that it acts as a cushion against the body of a swimmer.This prevents slipping and excessive pressure on the swimmer's body.

1 Claim, 2 Drawing Figures

DEVICE FOR IN PLACE SWIMMING

BACKGROUND OF THE INVENTION

This invention relates to a device for in place swimming. The object of the present invention is to provide a device for in place swimming which does not in any way hinder the natural swimming movement of the arms and legs. Further, it is desirable that such a device not lessen the beneficial effect of swimming.

According to the invention the beneficial effects of swimming are increased due to the resulting stretching effect of using the device. Use of the device tends to relieve pressure on the spine and alleviate back pain.

DETAILED DESCRIPTION

Figure 1:
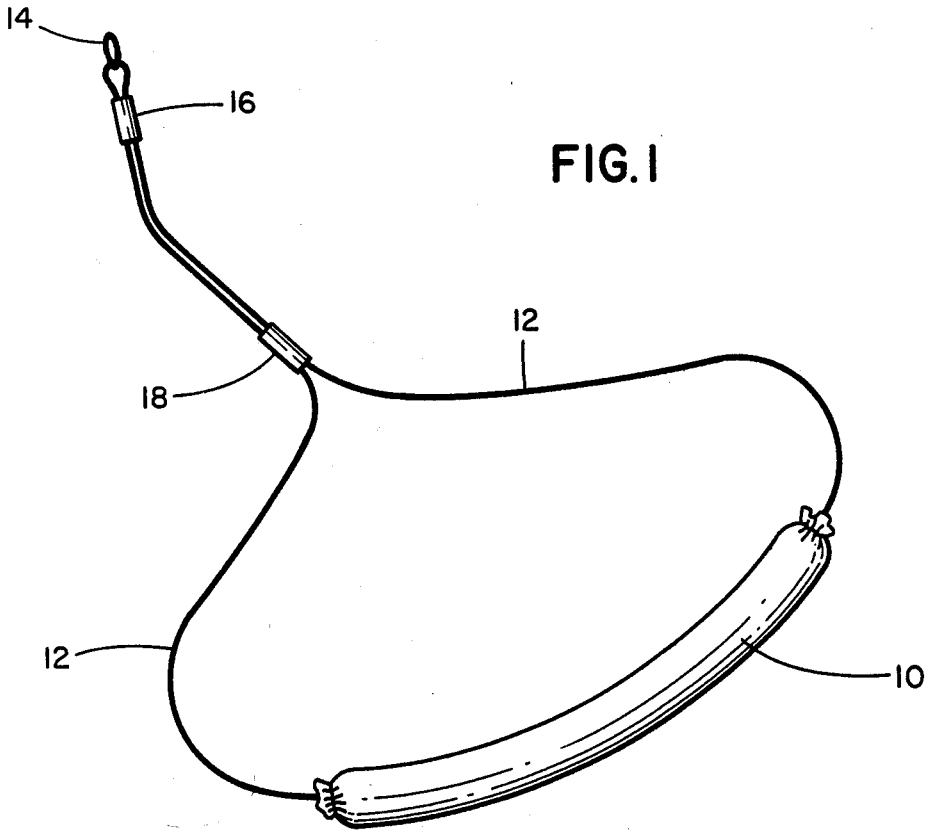
FIG. 1 is a perspective view of the device according to the invention.

The invention is shown in FIG. 1 and consists of a belt member 10 secured at either end of a flexible cord 12. At the mid-point of the cord a hook or loop 14 is provided for attachment to the side of a swimming pool. A pair of hollow tubular slide members 16 and 18 are provided over the cord for adjusting the cord dimensions to accommodate the swimmer.

The belt member 10 may be formed of various materials, such as, foam rubber and preferably is water absorbent. The water absorbency provides a cushioning effect to prevent the belt from binding against the swimmer and also reduces the tendency of the belt to slip off of the swimmer. The cord 12 is preferably made of elastic material so that there is a certain amount of give against the force exerted by the swimmer while still maintaining the swimmer in a substantially fixed position. While the cord has been indicated as preferably formed of a flexible material, it should be apparent that it could also be formed of nonflexible material, such as, leather, rope, or even wire. Similarly, although desirably formed of foam rubber the belt can be formed of nonflexible material, such as, leather, textile or rope. Adjustment of the device to accommodate the size of the swimmer is accomplished by use of tubular plastic members 16 and 18 which slide on the cord 12.

Figure 2:
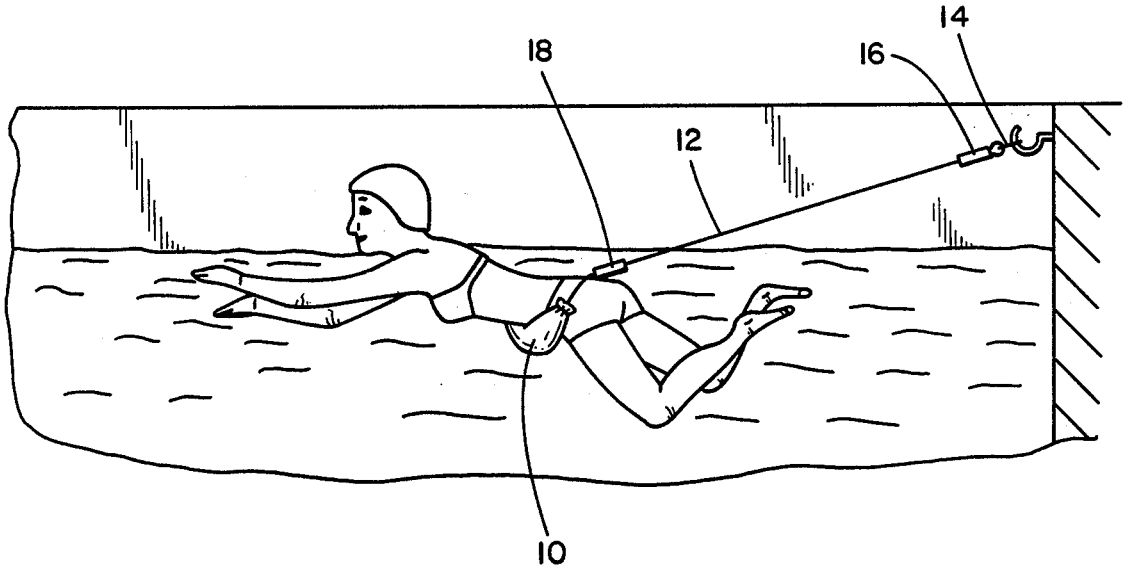
FIG. 2 is a side elevational view of a swimming pool in which the device is shown being used by a swimmer.

In order to use the device it is placed around the waist of the swimmer and the tubular member 18 is moved to a point where the belt is maintained snugly against the abdomen. The tubular member 16 is utilized for positioning the hook 14. The hook or similar device is then secured to the side of a swimming pool. As illustrated in FIG. 2, the swimmer can then swim in place against the tension provided by the cord without interference from the device.

The distance that the swimmer is located from the side of the pool is, of course, determined by the length of the cord 12. The cord may be shortened by knotting it above the member 16 if desired.

While I have shown and described embodiments of this invention in some detail, it will be understood that this description and illustrations are offered merely by way of example, and that the invention is to be limited in scope only by the appended claims.

I claim:

1. A device for in place swimming wherein a swimmer is tethered to the side of a swimming pool in a manner that permits unrestrained swimming strokes comprising:

a water absorbent foam rubber belt member to be placed against a portion of the body of the swimmer to prevent excessive pressure on the swimmer's body and to reduce slipping, an elastic cord attached to each end of said belt member, means for securing said cord to said pool side, and a slide member concentrically mounted on said cord for conforming the cord and belt member to the swimmer's body, whereby attachment of said securing means to the side of the pool permits a swimmer who has placed the belt member about his body to swim in place against the tension exerted by the secured cord.

* * * * *